US009415845B2

(12) United States Patent
Marciano

(10) Patent No.: US 9,415,845 B2
(45) Date of Patent: Aug. 16, 2016

(54) SEAT CONSTRUCTION FOR BABY FLOAT

(75) Inventor: Ralph C. Marciano, Riverside, RI (US)

(73) Assignee: Aqua-Leisure Industries, Inc., Avon, MA (US)

( * ) Notice: Subject to any disclaimer, the term of this patent is extended or adjusted under 35 U.S.C. 154(b) by 1198 days.

(21) Appl. No.: 12/837,746

(22) Filed: Jul. 16, 2010

(65) Prior Publication Data

US 2011/0014832 A1 Jan. 20, 2011

Related U.S. Application Data

(60) Provisional application No. 61/226,128, filed on Jul. 16, 2009.

(51) Int. Cl.

| | |
|---|---|
| ***B63C 9/08*** | (2006.01) |
| ***B63C 9/30*** | (2006.01) |
| ***B63B 35/76*** | (2006.01) |

(52) U.S. Cl.

CPC ..... *B63B 35/76* (2013.01); *Y10T 156/10* (2015.01); *Y10T 156/1034* (2015.01)

(58) Field of Classification Search

USPC ..... 441/129–132; 5/655

See application file for complete search history.

(56) References Cited

U.S. PATENT DOCUMENTS

| | | | | |
|---|---|---|---|---|
| 2,075,374 | A * | 3/1937 | Temple | 441/131 |
| 4,891,855 | A * | 1/1990 | Cheng-Chung | 5/710 |
| 5,090,930 | A * | 2/1992 | Walden | 441/131 |
| 5,429,852 | A * | 7/1995 | Quinn | 428/71 |
| 6,126,504 | A * | 10/2000 | Day | 441/131 |
| 7,926,135 | B1 * | 4/2011 | Leach | 5/655 |

* cited by examiner

*Primary Examiner* — Daniel V Venne

(74) *Attorney, Agent, or Firm* — Wolf, Greenfield & Sacks, P.C.

(57) ABSTRACT

According to one aspect, embodiments of the invention provide a seat construction for a float, the seat construction comprising an upper layer made of a first plastic material, a lower layer made of a second plastic material, and a middle layer made of a reinforced plastic material, wherein the middle layer is interposed between the upper layer and the lower layer, and wherein the upper layer and the lower layer are bonded together around an outer edge of the seat construction.

15 Claims, 3 Drawing Sheets

SEAT CONSTRUCTION FOR BABY FLOAT

RELATED APPLICATION

This application claims priority under 35 U.S.C. §119(e) to U.S. Provisional Application No. 61/226,128, entitled "SEAT CONSTRUCTION FOR BABY FLOAT," filed Jul. 16, 2009, which is hereby incorporated by reference in its entirety for all purposes.

BACKGROUND OF THE DISCLOSURE

1. Field of the Invention

At least one example in accordance with the present invention relates generally to floating pool and beach toys for babies and toddlers.

2. Discussion of Related Art

Floating pool and beach toys are oftentimes utilized to keep a young child, such as a baby or toddler, floating at the surface of a body of water while preventing the child from becoming submerged in the water. One example of a common floating pool and beach toy 100, illustrated in FIG. 1, includes a seat 102 affixed to and surrounded by a flotation device 104, such as a ring. A young child's legs (not shown) are inserted into apertures 106 in the seat 102 and the seat 102, in cooperation with the flotation device, supports the weight of the child and keeps the child afloat while the flotation device 104 rests on top of the water.

SUMMARY

Aspects in accord with the present invention are directed to a safe, sturdy and reliable seat construction for a baby float.

In one aspect the present invention features a seat construction for a float comprising an upper layer made of a first plastic material, a lower layer made of a second plastic material, and a middle layer made of a reinforced plastic material, wherein the middle layer is interposed between the upper layer and the lower layer, and wherein the upper layer and the lower layer are bonded together around an outer edge of the seat construction.

According to one embodiment, the upper layer, the lower layer and the middle layer each include at least one pair of aligned apertures. In another embodiment, the lower layer and the middle layer are bonded together around the circumference of each aperture. In one embodiment, the lower layer is folded over at least one of the middle layer and the upper layer around the circumference of each aperture.

According to another embodiment, the first plastic material and the second plastic material are Polyvinyl Chloride (PVC). In one embodiment the first plastic material is transparent. In one embodiment the reinforced plastic material is PVC mesh. In another embodiment the reinforced plastic material is laminated PVC.

According to one embodiment, the upper layer has a smaller diameter than the lower layer. In another embodiment the middle layer has a smaller diameter than the upper layer and the lower layer. In one embodiment, the middle layer is encompassed entirely by the upper and lower layers. In another embodiment the lower layer is configured to be bonded to a flotation device.

In another aspect the present invention features a method for constructing a seat for a float. The method may comprise interposing a layer of reinforced plastic material between an upper layer of plastic material and a lower layer of plastic material, and welding the upper layer of plastic material to the lower layer of plastic material around an outer edge of the seat.

According to one embodiment, the layer of reinforced plastic material, the upper layer and the lower layer each include at least one pair of aligned apertures, and the method may further comprise welding the layer of reinforced plastic material, the upper layer and the lower layer to each other around an edge of each aperture.

According to another embodiment, the method may further comprise folding the lower layer over at least one of the layer of reinforced plastic material and the upper layer around an edge of each aperture. In one embodiment, the method may further comprise welding the lower layer to a flotation device around an edge of the lower layer.

In another aspect the present invention features a seat construction for a float. The seat construction may comprise an upper layer made of a first plastic material, a lower layer made of a second plastic material, and means for reinforcing the seat construction, wherein the means for reinforcing the seat construction is interposed between the upper layer and the lower layer, and wherein the upper layer and the lower layer are bonded together around an outer edge of the seat construction.

According to one embodiment, the upper layer, the lower layer and the means for reinforcing the seat construction each include at least one pair of aligned apertures. In another embodiment, the upper layer, the lower layer and the means for reinforcing the seat construction are bonded together around the circumference of each aperture. In one embodiment, the lower layer is folded over at least one of the means for reinforcing the seat construction and the upper layer around the circumference of each aperture.

BRIEF DESCRIPTION OF DRAWINGS

The accompanying drawings are not intended to be drawn to scale. In the drawings, each identical or nearly identical component that is illustrated in various FIGs. is represented by a like numeral. For purposes of clarity, not every component may be labeled in every drawing. In the drawings.

DETAILED DESCRIPTION OF THE PREFERRED EMBODIMENTS

Figure 1:
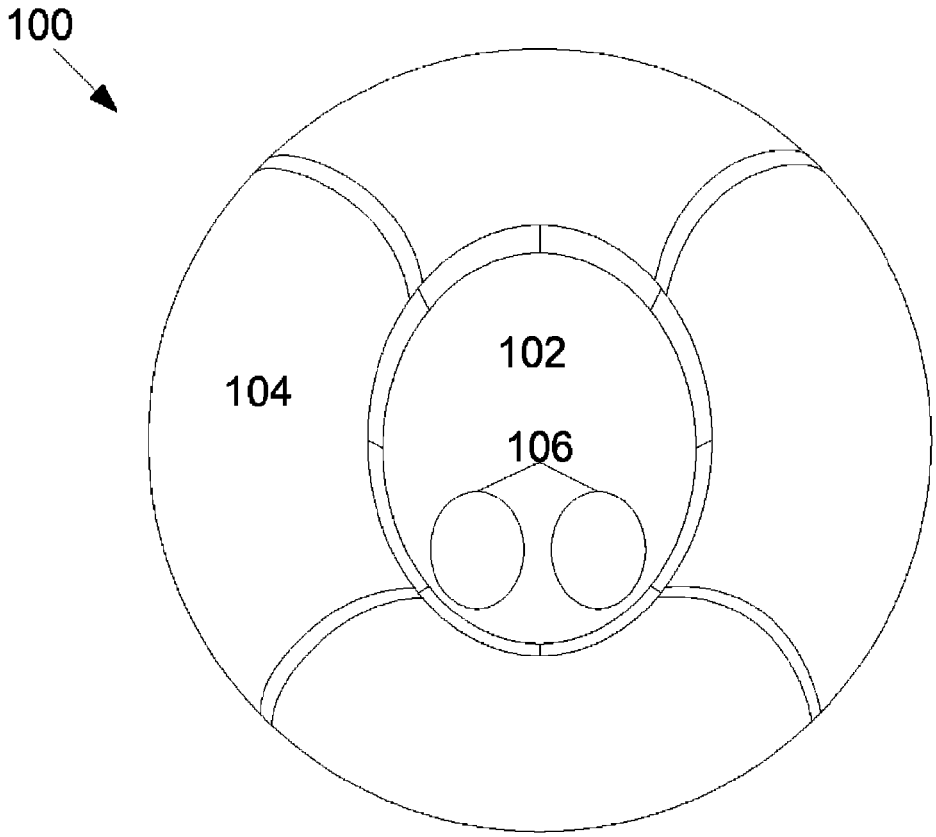
Prior Art FIG. 1
FIG. 1 is a diagram of a common floating pool and beach toy.

For the purposes of illustration only, and not to limit the generality, the present disclosure will now be described in detail with reference to the accompanying figures. This disclosure is not limited in its application to the details of construction and the arrangement of components set forth in the following description or illustrated in the drawings. The disclosure is capable of other embodiments and of being practiced or being carried out in various ways. Also the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

As described above, a common floating pool and beach toy 100 may include a seat 102 affixed to and surrounded by a flotation device 104. One example of a common construction of the seat 102 includes two layers of 7P sheet stock vinyl connected to form a seat construction (thickness) of 12 gauge to 16 gauge. However, such a construction of the seat 102 may result in strength and integrity problems. For example, when a seat constructed of only two vinyl layers is exposed to sunlight and heat, plasticizers within the vinyl may leach out at an accelerated rate, resulting in a weakening of the seat. As the seat weakens, it becomes susceptible to tearing, particularly in the area between the two apertures 106. If the vinyl in the seat begins to tear, the child being supported by the seat 102 may fall through the torn seat 102 into the water.

Figure 2:
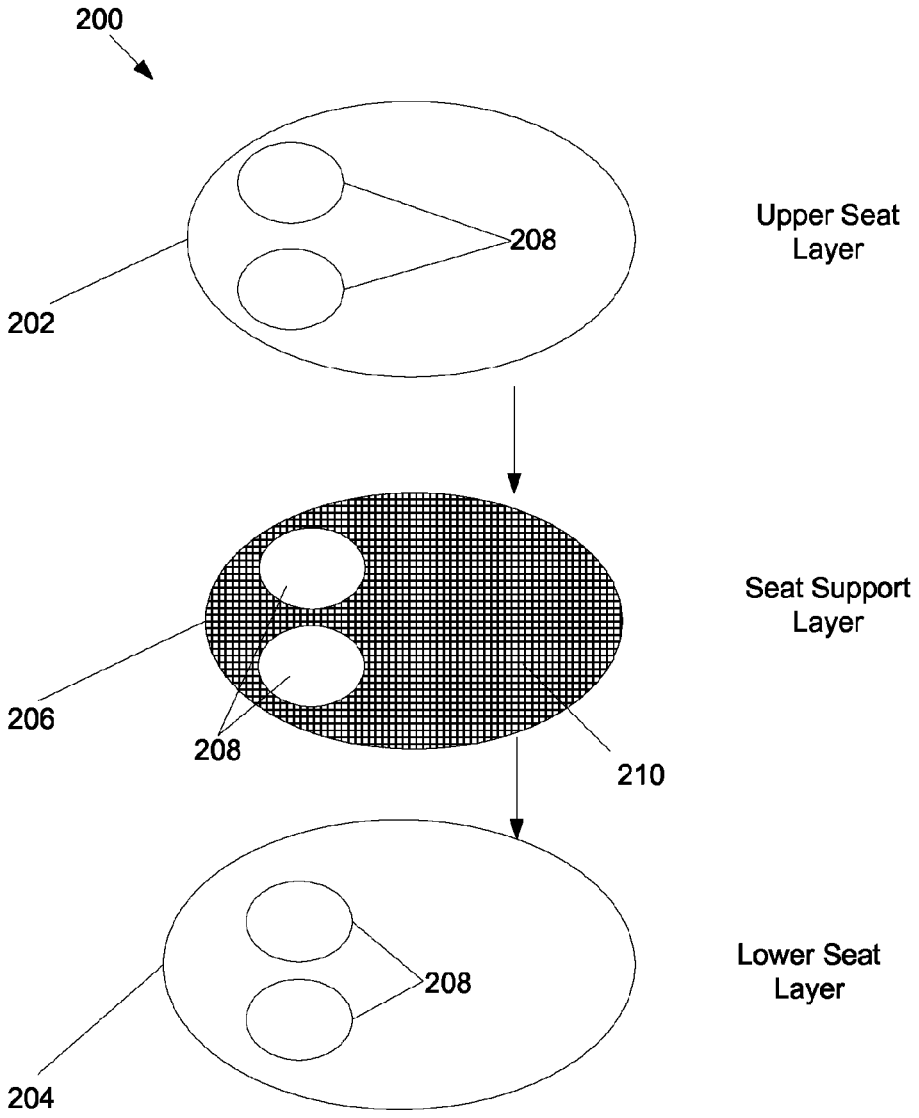
FIG. 2 is an exploded view diagram of a seat construction in accordance with aspects of the present invention.

FIG. 2 illustrates an exploded view of one embodiment of a seat construction 200 in accordance with the present invention. The seat construction 200 may mitigate the seat strength and integrity problem outlined above and provide a safe, sturdy and reliable seat for young children.

The seat construction 200 includes an upper seat layer 202, a lower seat layer 204 and a seat support layer 206. Each seat layer 202, 204, 206 includes a pair of apertures 208.

In one embodiment, the upper 202 and lower 204 seat layers are made of Polyvinyl Chloride (PVC). However, it is to be appreciated that the upper 202 and lower 204 seat layers may be made of any type of plastic capable of being welded by known techniques. Also, as illustrated in FIG. 2, the upper seat layer 202 has a slightly smaller diameter (i.e. 284 mm) than the lower seat layer 204 (300 mm). However, in other embodiments, the diameters of the upper 202 and lower 204 seat layers may be defined differently. For example, in one embodiment, the diameter of the lower seat layer 204 is smaller than the diameter of the upper seat layer 202 and in another embodiment, the diameters of the lower 204 and upper 202 seat layers are the same.

As illustrated in the embodiment of FIG. 2, the seat support layer 206 is made of PVC mesh 210. However, it is to be appreciated that the seat support layer 206 may be made of any type of reinforced plastic material such as laminated PVC. Also, in one embodiment, the seat support layer 206 is smaller in diameter (i.e. 268 mm) than the upper 202 and lower 204 seat layers (i.e. 284 mm and 300 mm respectively). However, in other embodiments, the diameter of the seat support layer 206 may be substantially the same as the diameter of the upper 202 and/or lower 202 seat layers.

The seat support layer 206 is interposed between the upper seat layer 202 and the lower seat layer 204 so that the apertures 208 are aligned. The seat support layer 206 provides added support and integrity to the seat construction 200 when the seat construction is connected to a flotation device (not shown). In one embodiment, the upper seat layer 202 is transparent, so as to make the seat support layer 206 visible to a user, thereby providing assurance to the person placing the child in the seat of the safety of the seat.

Figure 3:
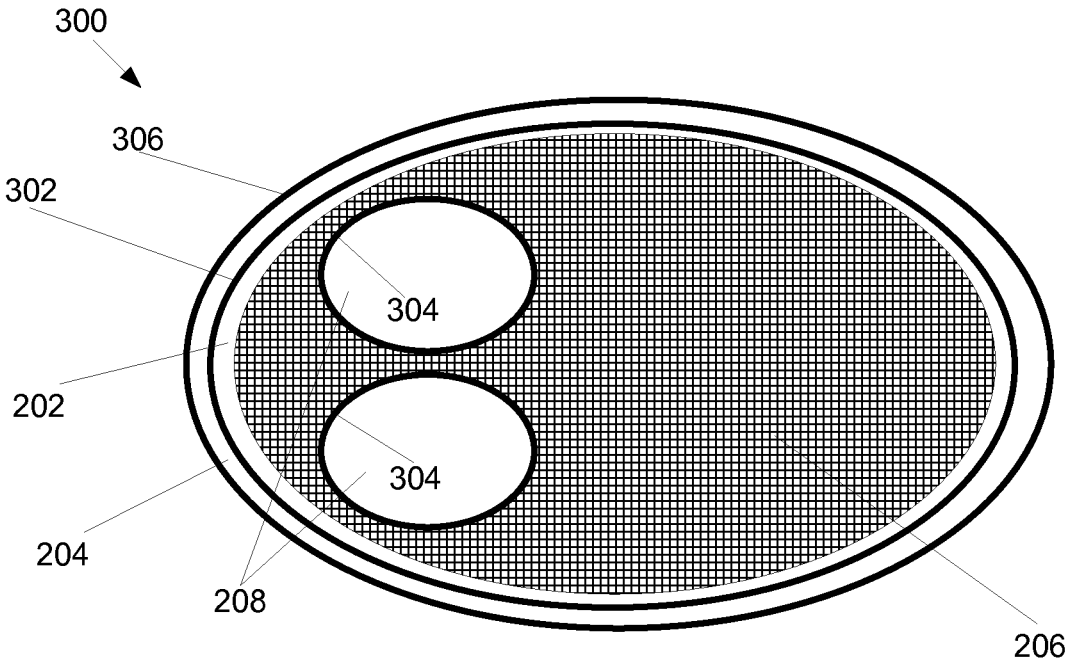
FIG. 3 is a diagram of an assembled seat construction in accordance with aspects of the present invention.

FIG. 3 illustrates an assembled seat construction 300 in accordance with at least one embodiment of the present invention. According to one embodiment, the upper 202 and lower 204 seat layers are welded together around an outer circumference 302 of the seat construction 300.

According to one embodiment, at the apertures 208, the lower 202, upper 204 and seat support 206 layers are welded together. For example, in one embodiment, the outer edge of the lower 204 seat layer is folded over both the seat support layer 206 and the upper layer 202 at the apertures 208 and the three layers 202, 204, 206 are welded together to form a strong seal 304. In another embodiment, at the apertures 208, the lower seat layer 202 is folded only over the upper layer 202 and the upper 202 and lower 204 seat layers are welded together to form a seal 304.

The outer edge or rim 306 of the lower 204 seat layer is welded to a flotation device (not shown) (i.e. to a side wall of the flotation device). It is to be appreciated that if the seat support layer's 206 diameter is less than that of the upper 202 and lower 204 seat layers, the seat support layer 206 may be encompassed entirely by the welded together upper 202 and lower 204 seat layers.

By including an independent, flexible and stable seat support layer 206 of reinforced plastic material in the seat construction 300, the strength and integrity of the seat construction 300 is increased. When the legs of a user (i.e. a young child such as a baby or toddler) are inserted into the apertures 208 and the user is placed on the seat construction 300, the seat construction supports the weight of the user and the seat support layer 206 helps to prevent structural failure of the seat.

Having thus described at least one embodiment of the present disclosure, various alternations, modifications and improvements will readily occur to those skilled in the art. Such alterations, modifications and improvements are intended to be within the scope and spirit of the disclosure. Accordingly, the foregoing description is by way of example only and is not intended to be limiting. The disclosure's limit is defined only in the following claims and equivalents thereto.

What is claimed is:

1. A seat construction for a float, the seat construction comprising:

an upper layer made of a first plastic material;

a lower layer made of a second plastic material; and a middle layer interposed between the upper layer and the lower layer, wherein the upper layer, middle layer, and lower layer are configured, in combination, to support a user placed on the seat construction, wherein the middle layer is comprised of a reinforced plastic material configured to increase the strength and integrity of the seat construction to prevent structural failure of the seat construction while the user is placed on the seat construction, wherein the upper layer and the lower layer are bonded together around an outer edge of the seat construction, and wherein the first plastic material of the upper layer is transparent so as to make the middle layer visible to the user.

2. The seat construction of claim 1, wherein the upper layer, the lower layer and the middle layer each include at least one pair of aligned apertures.

3. The seat construction of claim 2, wherein the upper layer and the lower layer are bonded together around the circumference of each aperture.

4. The seat construction of claim 3, wherein the lower layer is folded over at least one of the middle layer and the upper layer around the circumference of each aperture.

5. The seat construction of claim 1, wherein the first plastic material and the second plastic material are Polyvinyl Chloride (PVC).

6. The seat construction of claim 1, wherein the reinforced plastic material is PVC mesh.

7. The seat construction of claim 1, wherein the reinforced plastic material is laminated PVC.

8. The seat construction of claim 1, wherein the upper layer has a smaller diameter than the lower layer.

9. The seat construction of claim 1, wherein the middle layer has a smaller diameter than the upper layer and the lower layer.

10. The seat construction of claim 9, wherein the middle layer is encompassed entirely by the upper and lower layers.

11. The seat construction of claim 1, wherein the lower layer is configured to be bonded to a flotation device.

12. A method for constructing a seat for a float, the method comprising:

interposing a middle layer of reinforced plastic material between an upper layer of plastic material and a lower layer of plastic material, wherein the upper layer, lower layer and middle layer are configured, in combination, to support a user placed on the seat, wherein the reinforced plastic material of the middle layer is configured to increase the strength and integrity of the seat to prevent structural failure of the seat while the user is placed on the seat, and wherein the upper layer of plastic material is transparent so as to make the middle layer of reinforced plastic material visible to the user; and welding the upper layer of plastic material to the lower layer of plastic material around an outer edge of the seat.

13. The method of claim 12, wherein the layer of reinforced plastic material, the upper layer and the lower layer each include at least one pair of aligned apertures, and wherein the method further comprises welding the layer of reinforced plastic material, the upper layer and the lower layer to each other around an edge of each aperture.

14. The method of claim 12, wherein the method further comprises folding the lower layer over at least one of the layer of reinforced plastic material and the upper layer around an edge of each aperture.

15. The method of claim 12, further comprising welding the lower layer to a flotation device around an edge of the lower layer.

* * * * *